US005483910A

United States Patent [19]

Skaarub et al.

[11] Patent Number: 5,483,910

[45] Date of Patent: Jan. 16, 1996

[54] SELF-LAUNCHING SUPERSTRUCTURE FOR VESSELS

[75] Inventors: Ole Skaarub, Greenwich; James H. Hara, Ridgefield, both of Conn.

[73] Assignee: Skarhar, Inc., Greenwich, Conn.

[21] Appl. No.: 913,247

[22] Filed: Jul. 14, 1992

[51] Int. Cl.[6] ..... B63B 29/02

[52] U.S. Cl. ..... 114/71; 114/77 A

[58] Field of Search ..... 114/71, 77 R, 114/77 A, 248

[56] References Cited

U.S. PATENT DOCUMENTS

| | | | |
|---|---|---|---|
| 738,400 | 9/1903 | Booker | 114/77 R |
| 1,061,153 | 5/1913 | Wolfe | 114/77 R |
| 1,064,472 | 6/1913 | Haas | 114/77 A |
| 1,076,068 | 10/1913 | Schleicher | 114/77 A |
| 1,087,385 | 2/1914 | Kincaid | 114/77 A |
| 1,198,439 | 9/1916 | Herfjord | 114/77 A |
| 1,220,408 | 3/1917 | Foster | 114/777 A |
| 2,057,995 | 10/1936 | Badovici | 114/77 R |

FOREIGN PATENT DOCUMENTS

| | | | |
|---|---|---|---|
| 2904245 | 8/1980 | Germany | 114/77 R |
| 269165 | 11/1929 | Italy | 114/77 R |
| 1023983 | 3/1966 | United Kingdom | 114/77 A |

*Primary Examiner*—Michael S. Huppert
*Assistant Examiner*—Thomas J. Brahan
*Attorney, Agent, or Firm*—John H. Crozier

[57] ABSTRACT

In a preferred embodiment, a self-launching superstructure for a vessel, the superstructure including: a floatable hull having a forward bottom portion sloping downwardly from near a waterline near a bow end of the superstructure to a point near a stern end of the superstructure; the forward bottom portion being engagable with a corresponding sloped floor on the vessel when the superstructure is mounted on the vessel, the sloped floor terminating at an edge of the vessel, such that the superstructure, under gravitational force, may slide from the vessel into water in which the vessel is floating; and apparatus to releasably secure the superstructure on the vessel with the forward bottom portion of the hull engaging the sloped floor.

9 Claims, 8 Drawing Sheets

SELF-LAUNCHING SUPERSTRUCTURE FOR VESSELS

BACKGROUND OF THE INVENTION

1. Field of the Invention

The present invention relates to vessels generally and, more particularly, but not by way of limitation, to a novel superstructure for such vessels that is self-launching from the vessel in case of emergency.

2. Background Art

Safety at sea has been a concern for the several thousand years that man has traveled the seas in boats. In recent times, safety codes have required that certain safety equipment be aboard vessels, the safety equipment generally comprising one or more lifeboats that are lowered to the surface of the water by means of davits when an emergency occurs.

While such lifeboats have been instrumental in saving lives, there are many situations, such as fires, explosions, breaking up, and/or other major emergencies that preclude the launching of some or all of the lifeboats and, consequently, some or all of the crew aboard the vessel may be lost. There are many accounts of vessels being lost without a trace, presumably due to some rapidly occurring emergency, such as an explosion or the sudden breaking up of the vessels.

Accordingly, it is a principal object of the present invention to provide means for saving the crew of a vessel in the event of an emergency, which means is quickly and rapidly deployed in the event of an emergency.

It is a further object of the invention to provide such means that is more likely to save all of the crew aboard the vessel.

It is an additional object of the invention to provide such means that is economically constructed and contributes to a more economically constructed and operated vessel.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, a self-launching superstructure for a vessel, said superstructure comprising: a floatable hull having a forward bottom portion sloping downwardly from near a waterline near a bow end of said superstructure to a point near a stern end of said superstructure; said forward bottom portion being engagable with a corresponding sloped floor on said vessel when said superstructure is mounted on said vessel, said sloped floor terminating at an edge of said vessel, such that said superstructure, under gravitational force, may slide from said vessel into water in which said vessel is floating; and means to releasably secure said superstructure on said vessel with said forward bottom portion of said hull engaging said sloped floor.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
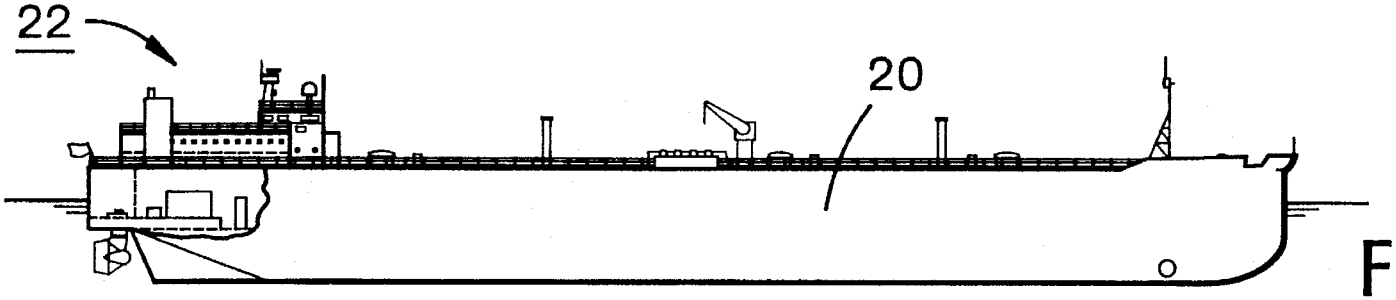
FIG. 1 is a side elevational view, partially cut-away, of a vessel with the superstructure of the present invention mounted thereon.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

Figure 2:
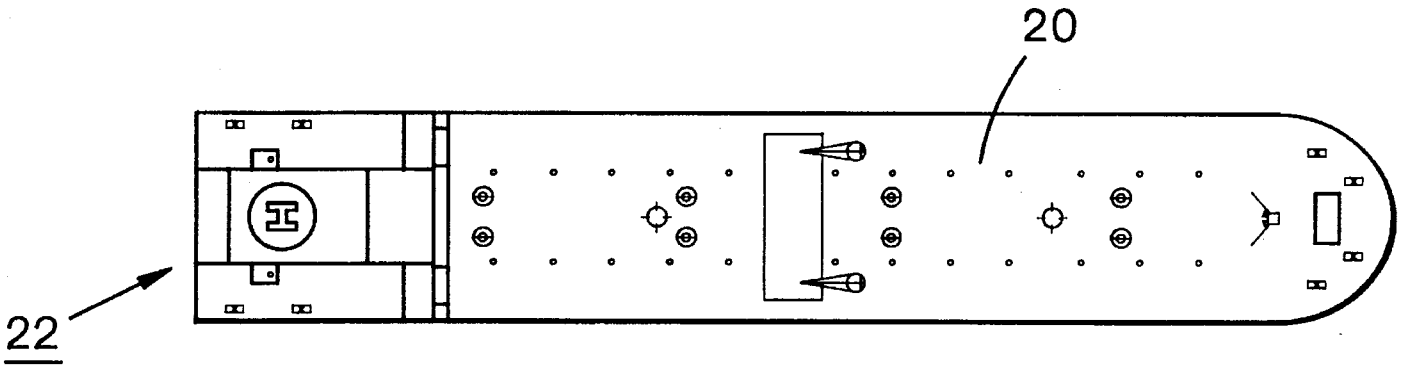
FIG. 2 is a top plan view of the vessel and superstructure.
Figure 3:
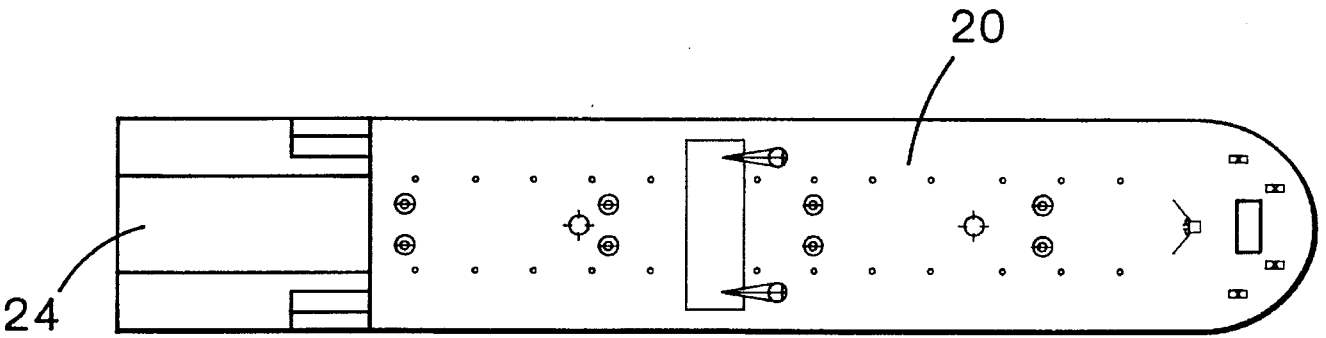
FIG. 3 is a top plan view of the vessel without the superstructure.

FIGS. 1–3 illustrate the general arrangement of the invention, here including a vessel 20 having mounted thereon a superstructure, generally indicated by the reference numeral 22. Superstructure 22 is disposed in the normal position in proximity to the stern of vessel 20 (FIGS. 1 and 2). FIG. 3 illustrates that superstructure 22 is mounted in a launching recess 24.

Figure 4:
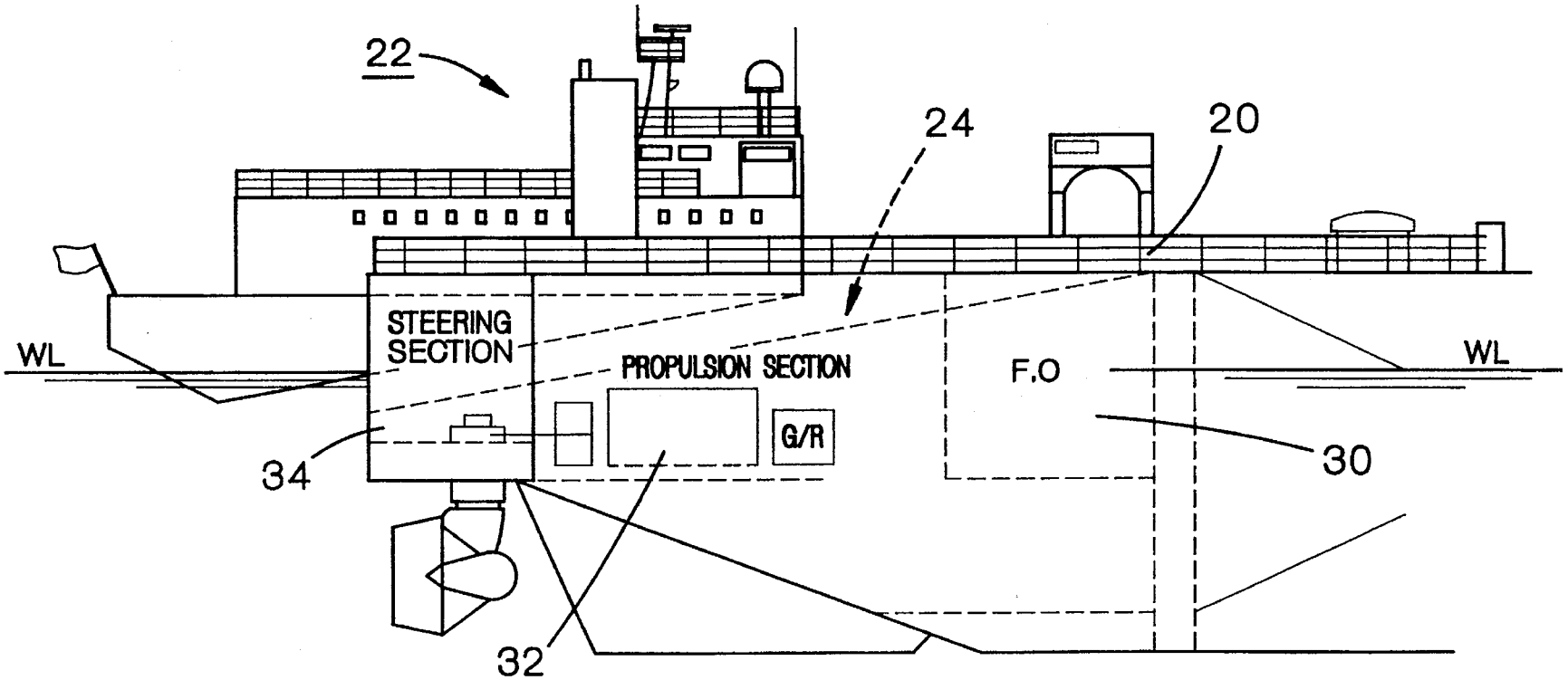
FIG. 4 is a fragmentary side elevational view of the superstructure being launched from the vessel.

FIG. 4 illustrates superstructure 22 being launched from vessel 20. It can be seen that the bottom of superstructure 22 and the floor of launching recess 24 have complementary slopes, sloping from a point inboard of the stern of vessel to the edge of the stern thereof. As shown, superstructure 22 has slid down launching recess 24 (FIG. 3) and is now floating in the water. FIG. 4 also illustrates that within the stern section of vessel 20 are disposed a fuel oil tank 30, a propulsion section 32, and a steering section 34.

Figure 5:
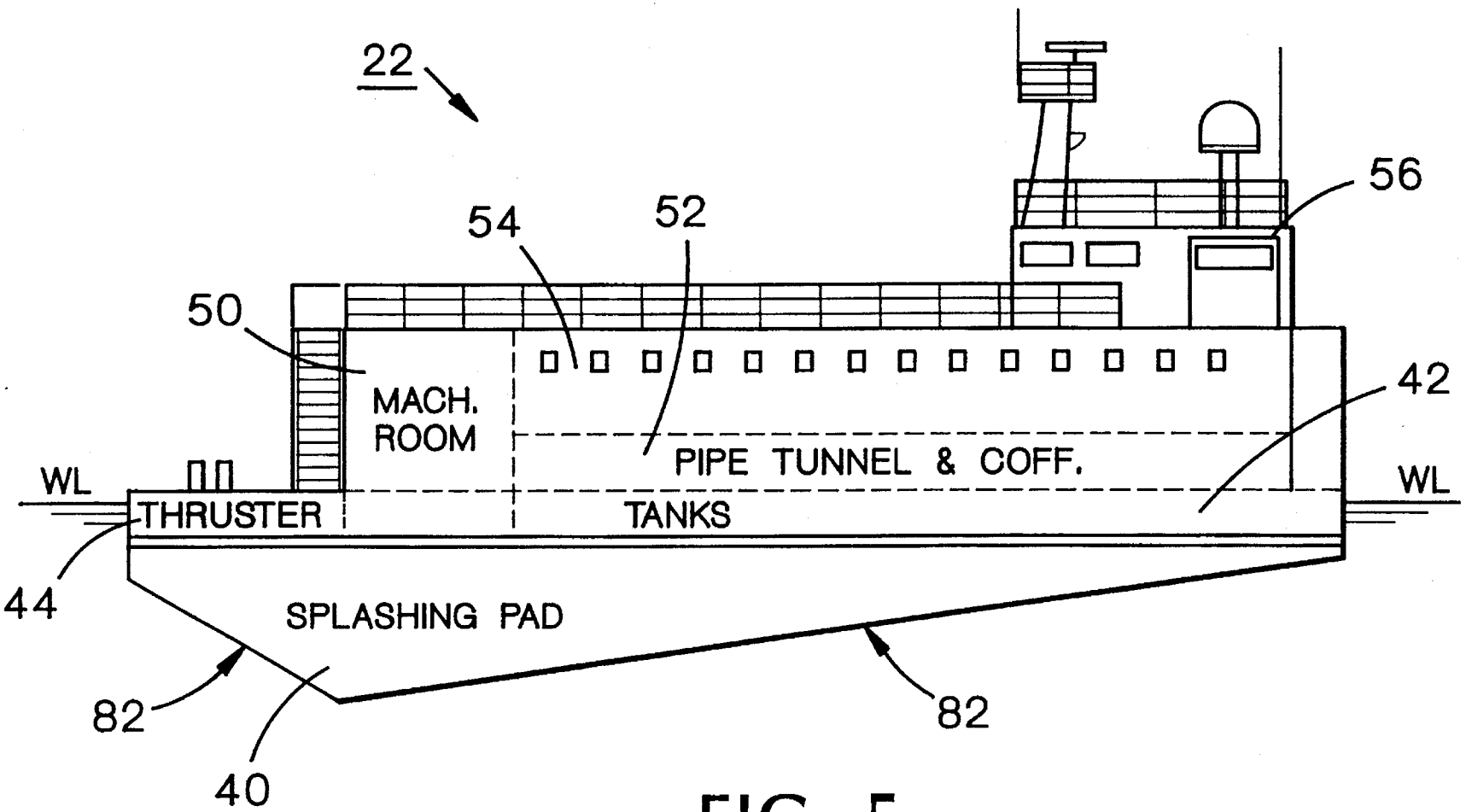
FIG. 5 is a side elevational view of the superstructure.
Figure 6:
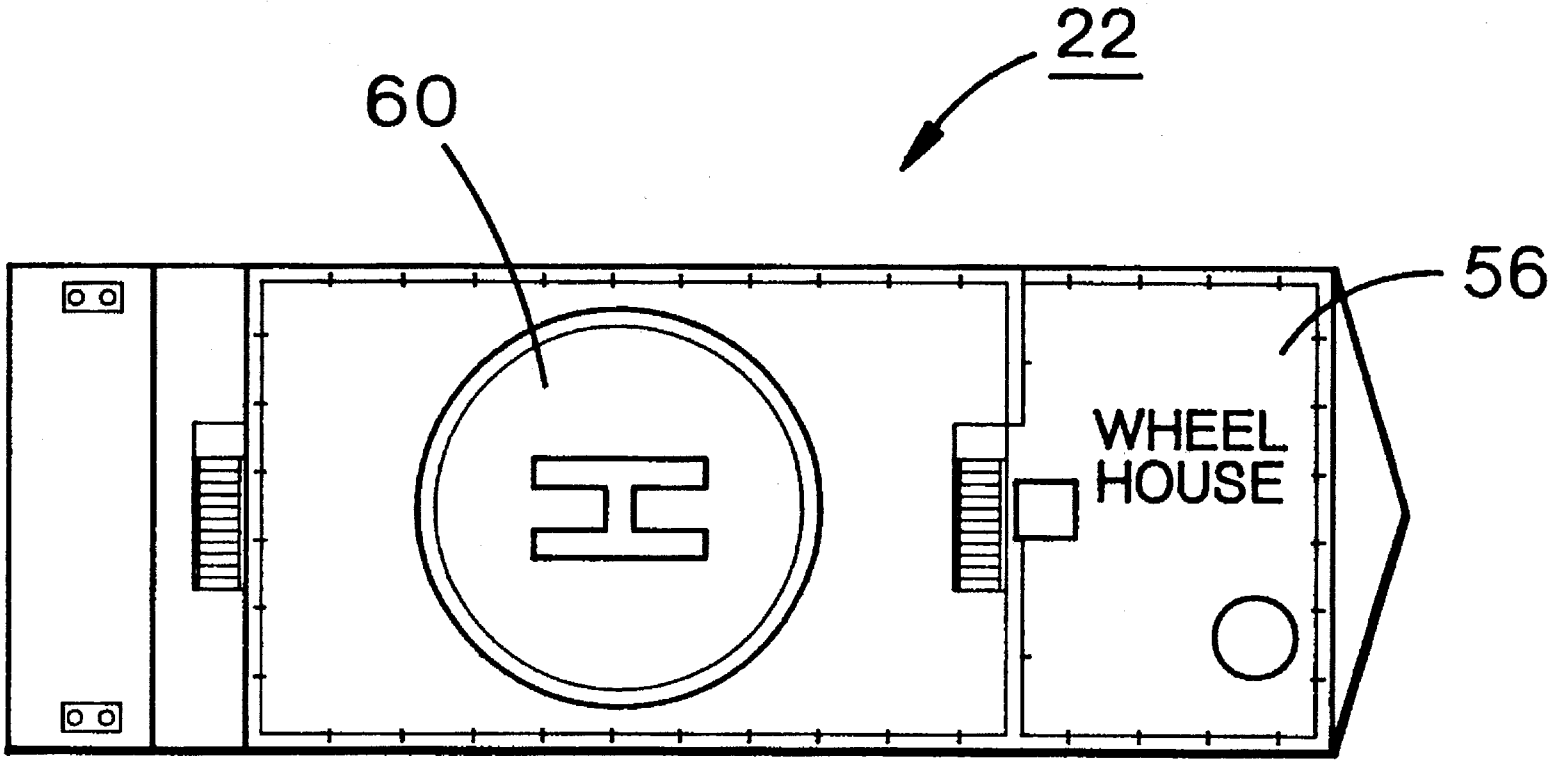
FIG. 6 is a top plan view of the superstructure.
Figure 7:
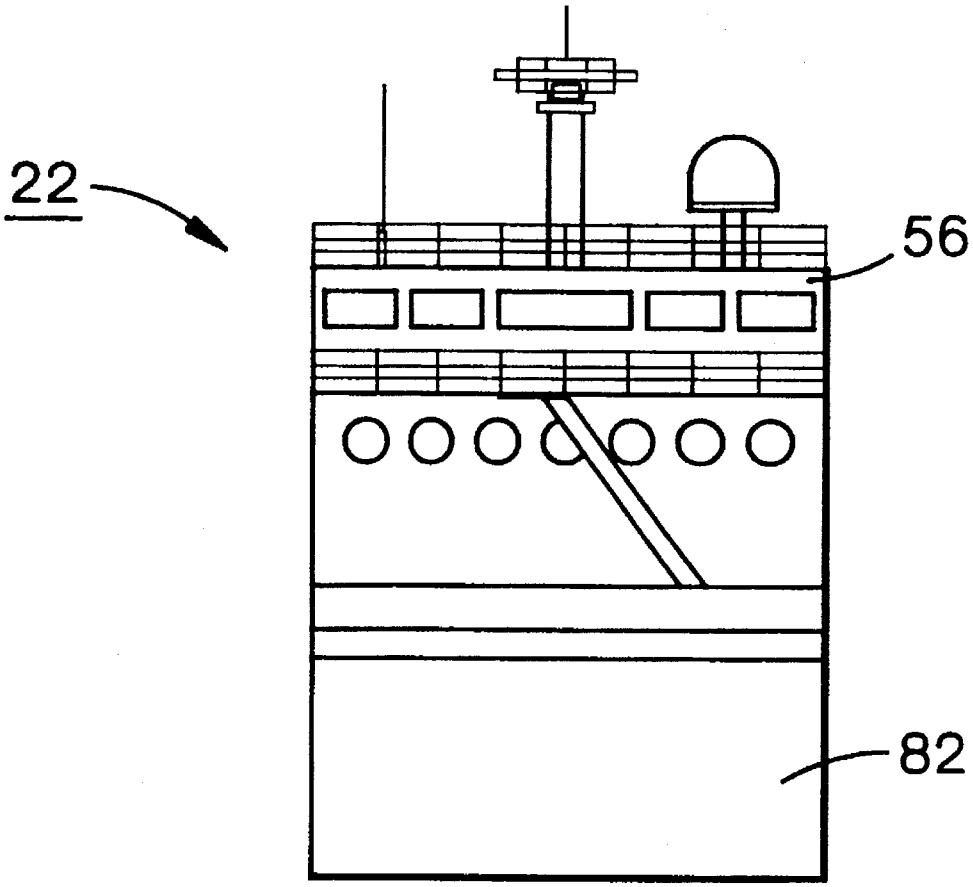
FIG. 7 is a rear elevational view of the superstructure.

Reference to FIGS. 5–7 should now be made for a fuller understanding of the construction of superstructure 22. Superstructure 22 is, in fact, a self-contained watercraft. The hull of superstructure 22 includes (FIG. 5) a splashing pad 40, fuel tanks 42, and a thruster 44 for propulsion and steering. The upper portion of superstructure 22 includes (FIG. 5) a machine room 50, a pipe tunnel and cofferdam 52, crew quarters 54, and a wheel house 56 (also FIG. 6). A helicopter pad 60 (FIG. 6) is disposed on top of superstructure 22.

Referring to FIG. 5, it can be seen that the forward bottom portion 80 of splashing pad 40 is flat and is sloped from near the waterline at the bow of superstructure 22 downwardly to a point near the stern of the superstructure. This slope corresponds to the slope of the floor of launching recess 24 (FIGS. 3 and 4) and must be sufficient to permit superstructure 22 to be launched in any conditions and may be on the order of about 10 degrees from horizontal. The aftermost bottom portion 82 of splashing pad 40 is flat and is sloped upwardly from forward portion 80 toward the waterline at the stern of superstructure 22 to permit superstructure 22 to safely enter the water as it slides from launching recess 24 and may be sloped on the order of about 30 degrees from horizontal.

Figure 8:
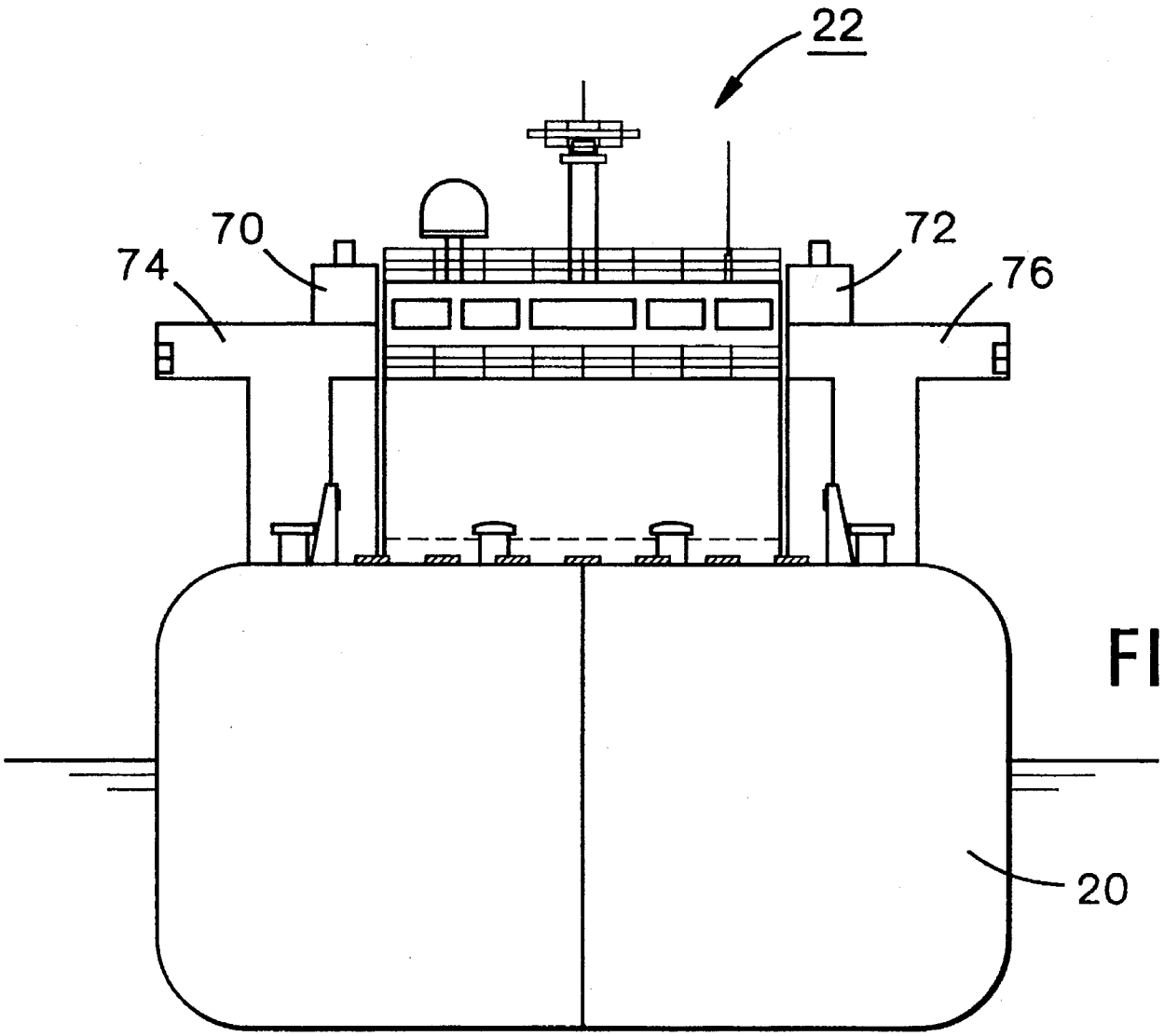
FIG. 8 is a front elevational view of the vessel with the superstructure mounted thereon.
Figure 9:
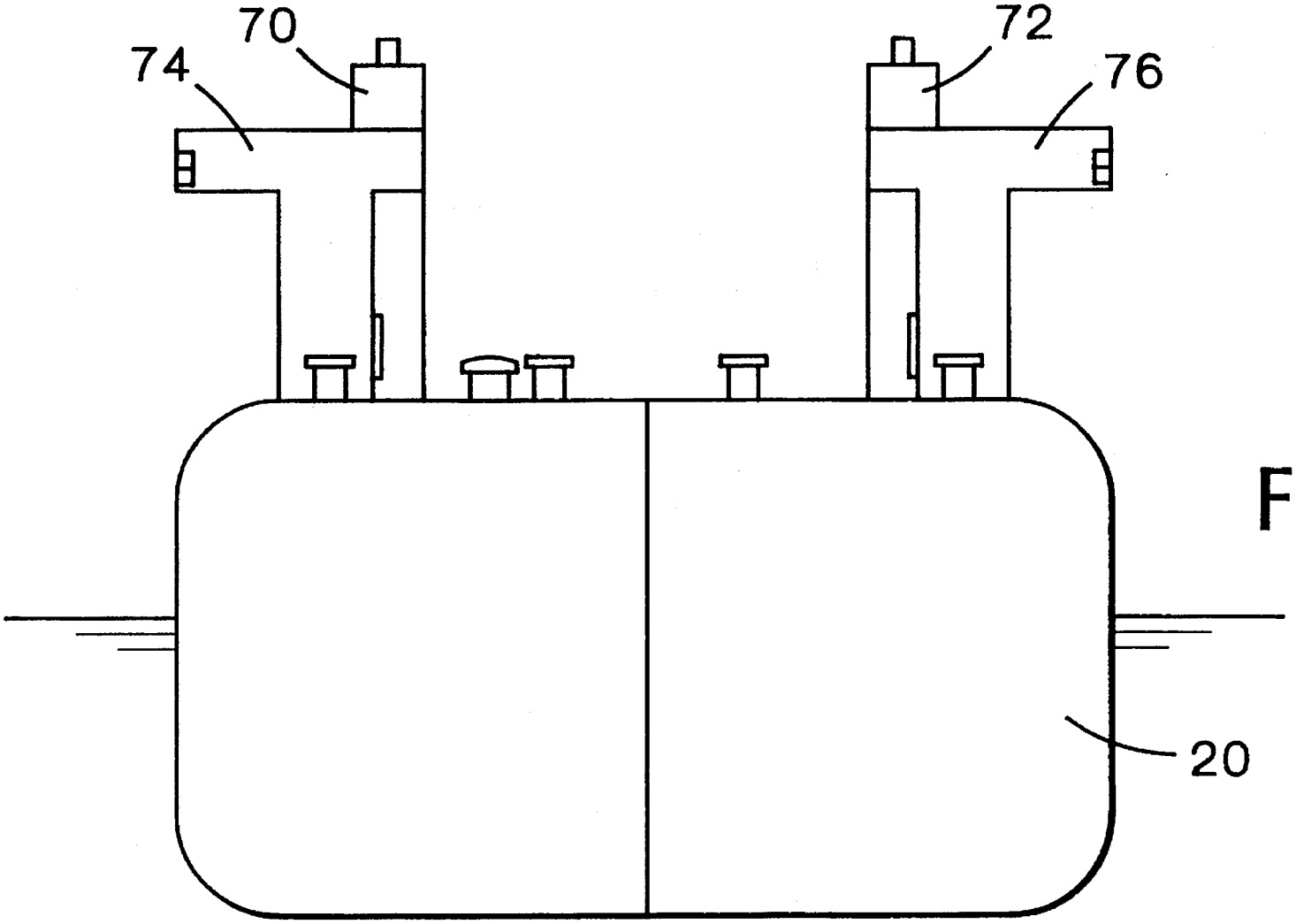
FIG. 9 is a front elevational view of the vessel without the superstructure.

FIG. 8 illustrates superstructure 22 mounted on vessel 20 between stacks 70 and 72 and elevated side decks 74 and 76. FIG. 9 illustrates vessel 20 after superstructure 22 has been launched therefrom.

In use, superstructure 22 is mounted on vessel 20 and is secured in place by any suitable quickly released means and preferably is secured in place by the type of trigger mechanism conventionally employed in shipyards to hold ships in the ways during construction. In the event of an emergency, the trigger is released and gravitational force causes superstructure 22 to slide from launching recess 24 into the water. To reduce friction, the floor and sides of launching recess 24 may have a surface formed of a polymeric material or of some other conventional friction reducing material. Once launched, superstructure 22 is seaworthy, utilizes its own power source to control movement (44, FIG. 5), and provides complete life support services for the crew members.

Figure 10:
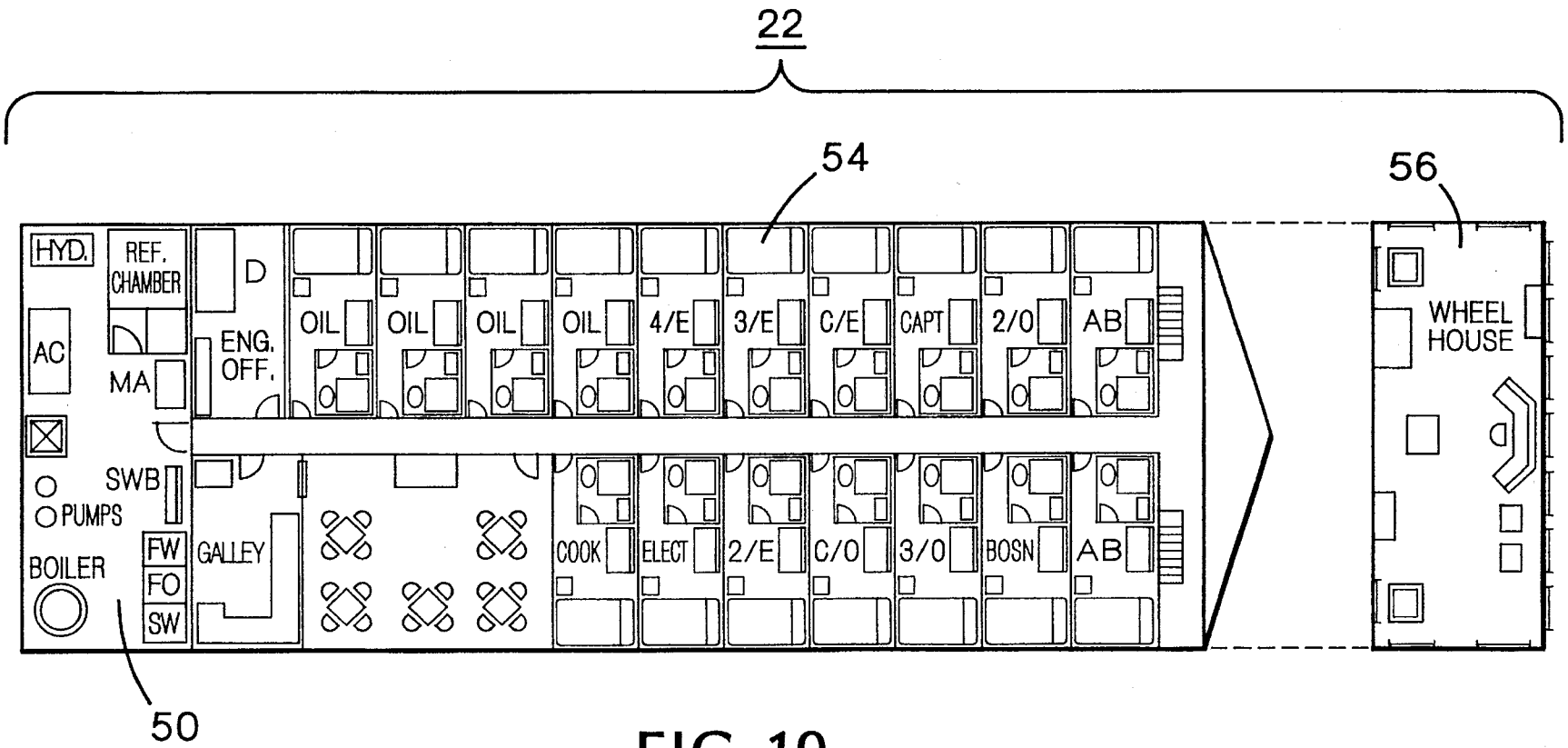
FIG. 10 is a cross-sectional view of the superstructure.

A further advantage of the present invention is that much mechanical equipment conventionally installed in the engine room of a vessel may be installed in superstructure 22. For example, in the conventional construction of vessels, generators, pumps, fresh water supply, heaters, air conditioners, hydraulic, and other auxiliary equipment are installed in the engine room of the vessel. This equipment is largely to support the activities in the superstructure of the vessel and requires a large amount of piping and wiring between the engine room and the superstructure. In accordance with the present invention, all this auxiliary equipment is installed in machine room 50 (FIG. 10) of superstructure 22 and, thus, is located close to the activities it services. This eliminates the above piping and wiring between the engine room and the superstructure and makes the superstructure self-sufficient.

Having the auxiliary equipment in superstructure 22 also contributes an additional safety feature, since crew members don't have to leave the superstructure to attend to that equipment and will spend more of their time in superstructure 22; therefore, the crew members are more likely to be in the superstructure when an emergency occurs.

The necessary control lines (not shown) between wheel house 56 (FIG. 5) and propulsion section 32 (FIG. 4) can be disposed in an umbilical cord arrangement that is automatically broken as superstructure 22 is launched. Should the emergency comprise the sudden breaking up of vessel 20, the trigger mechanism can be released and superstructure 22 will simply float free of the vessel. Vessel 20 may also have conventional liferafts.

The mechanical equipment remaining in vessel 20 largely comprises the main power plant for the vessel (32, FIG. 4). This arrangement affords economy in construction, since superstructure 22 can be built in a separate yard which specializes in such construction, while vessel 20 can be built in a conventional shipyard and the two later joined. For further economy, the design of superstructure 22 can be standardized. The interior of superstructure 22 (FIG. 10) has a clean layout and piping and wiring can be centralized and routed through pipe tunnel and cofferdam 52 (FIG. 52) from machine room 50 to the rest of the superstructure.

Superstructure 22 may be constructed using materials and methods conventional in the shipbuilding industry.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

We claim:

1. A vessel with a self-launching superstructure, comprising:

(a) a vessel hull having therein a main power plant and a steering section for propulsion and steering of said vessel;

(b) said self-launching superstructure being disposed upon said hull and having therein a wheel house for said vessel and controls for said steering section and said main power plant; and (c) said self-launching superstructure being launchable from said vessel by sliding down a sloped floor on said vessel into water in which said vessel is floating.

2. A vessel with a self-launching superstructure, as defined in claim 1, wherein:

(a) said self-launching superstructure includes a floatable hull having a forward bottom portion sloping downwardly from a point toward a bow end of said superstructure to a point toward a stern end of said superstructure;

(b) said forward bottom portion being engagable with corresponding said sloped floor on said vessel when said superstructure is mounted on said vessel, said sloped floor terminating at an edge of said vessel, such that said superstructure, under gravitational force, may slide from said vessel into water in which said vessel is floating; and (c) means to releasably secure said superstructure on said vessel with said forward bottom portion of said superstructure hull engaging said sloped floor.

3. A vessel with a self-launching superstructure, as defined in claim 2, further comprising said superstructure hull having an aftermost bottom portion sloping upwardly from said forward bottom portion toward a stern end of said superstructure, such as to permit said superstructure to safely enter, stern first, the water in which said vessel is floating when said superstructure is launched from said vessel.

4. A vessel with a self-launching superstructure, as defined in claim 2, wherein the slope angle of said forward bottom portion is on the order of about 10 degrees from horizontal.

5. A vessel with a self-launching superstructure, as defined in claim 3, wherein said aftermost bottom portion is flat and the slope angle of said aftermost bottom portion is on the order of about 30 degrees from horizontal.

6. A vessel with a self-launching superstructure, as defined in claim 1, further comprising propulsion and steering means disposed in said superstructure to propel and steer said superstructure after said superstructure is launched from said vessel.

7. A vessel with a self-launching superstructure, as defined in claim 1, further comprising auxiliary equipment disposed in said self-launching superstructure to provide life support services for crew members of said superstructure after said superstructure is launched from said vessel.

8. A vessel with a self-launching superstructure, as defined in claim 7, wherein said auxiliary equipment comprises one or more items selected from the group consisting of generators, pumps, fresh water supply, heaters, air conditioners, and hydraulic equipment.

9. A vessel with a self-launching superstructure, as defined in claim 1, wherein said self-launching superstructure further has crew living quarters and work areas disposed therein, such that essentially all manned activities required when said vessel is underway take place in said self-launching superstructure.

* * * * *

UNITED STATES PATENT AND TRADEMARK OFFICE

CERTIFICATE OF CORRECTION

PATENT NO. : 5,483,910

DATED : January 16, 1996

INVENTOR(S) : Ole Skaarup et al

It is certified that error appears in the above-indentified patent and that said Letters Patent is hereby corrected as shown below:

On the title page: Item [75] please delete "Ole Skaarub" and substitute therefor -- Ole Skaarup --.

Signed and Sealed this

Sixteenth Day of April, 1996

Bruce Lehman

*Attest:*

BRUCE LEHMAN

*Attesting Officer*

*Commissioner of Patents and Trademarks*